US009941107B2

(12) United States Patent
Verenchikov

(10) Patent No.: US 9,941,107 B2
(45) Date of Patent: Apr. 10, 2018

(54) CYLINDRICAL MULTI-REFLECTING TIME-OF-FLIGHT MASS SPECTROMETER

(71) Applicant: LECO Corporation, St. Joseph, MI (US)

(72) Inventor: Anatoly N. Verenchikov, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 14/441,700

(22) PCT Filed: Nov. 8, 2013

(86) PCT No.: PCT/US2013/069155
§ 371 (c)(1),
(2) Date: May 8, 2015

(87) PCT Pub. No.: WO2014/074822
PCT Pub. Date: May 15, 2014

(65) Prior Publication Data

US 2015/0279650 A1 Oct. 1, 2015

Related U.S. Application Data

(60) Provisional application No. 61/724,504, filed on Nov. 9, 2012.

(51) Int. Cl.
*H01J 49/40* (2006.01)
*H01J 49/00* (2006.01)

(52) U.S. Cl.
CPC ..... *H01J 49/406* (2013.01); *H01J 49/0031* (2013.01); *H01J 49/405* (2013.01); *H01J 2237/121* (2013.01)

(58) Field of Classification Search
None
See application file for complete search history.

(56) References Cited

U.S. PATENT DOCUMENTS

2001/0011703 A1 8/2001 Franzen
2004/0232328 A1* 11/2004 Ding ..... H01J 49/424 250/292

(Continued)

FOREIGN PATENT DOCUMENTS

EP 1665326 B1 4/2010
WO WO-2011-107836 A1 9/2011

(Continued)

OTHER PUBLICATIONS

Japanese Office Action for the related Application No. 2015-538168 dated Apr. 20, 2016.

(Continued)

*Primary Examiner* — Wyatt Stoffa
*Assistant Examiner* — James Choi
(74) *Attorney, Agent, or Firm* — Honigman Miller Schwartz and Cohn LLP

(57) ABSTRACT

A method and apparatus are disclosed for improving resolution and duty-cycle of a multi-reflecting TOF mass spectrometer (MR-TOF) by arranging a cylindrical analyzer having an appropriate radial deflection means, means for limiting ion divergence in the tangential direction and a pulsed source providing ion packet divergence of less than 1 mm*deg. There are disclosed embodiments for fifth-order focusing cylindrical ion minors. Separate embodiments provide parallel tandem MS-MS within a single cylindrical MR-TOF.

20 Claims, 6 Drawing Sheets

(56) References Cited

U.S. PATENT DOCUMENTS

| | | | | |
|---|---|---|---|---|
| 2007/0194223 | A1 | 8/2007 | Sato et al. | |
| 2010/0148060 | A1* | 6/2010 | Panayi | H01J 49/0004 250/286 |
| 2011/0168880 | A1 | 7/2011 | Ristroph et al. | |
| 2013/0048852 | A1* | 2/2013 | Verenchikov | H01J 49/0031 250/282 |
| 2013/0056627 | A1* | 3/2013 | Verenchikov | H01J 49/406 250/282 |
| 2015/0028197 | A1* | 1/2015 | Grinfeld | H01J 49/406 250/282 |
| 2015/0318156 | A1* | 11/2015 | Loyd | H01J 49/068 250/287 |
| 2016/0018368 | A1* | 1/2016 | Sapargaliyev | G01N 30/72 250/283 |

FOREIGN PATENT DOCUMENTS

| | | | | |
|---|---|---|---|---|
| WO | WO 2011107836 | A1 * | 9/2011 | H01J 49/406 |
| WO | WO 2011135477 | A1 * | 11/2011 | H01J 49/0031 |
| WO | WO-2011135477 | A1 | 11/2011 | |

OTHER PUBLICATIONS

International Search Report dated Feb. 18, 2014, with respect to International Application No. PCT/US2013/069155.

* cited by examiner

CYLINDRICAL MULTI-REFLECTING TIME-OF-FLIGHT MASS SPECTROMETER

TECHNICAL FIELD

The invention generally relates to the area of mass spectroscopic analysis, and more in particularly is concerned with improving sensitivity and resolution of multi-reflecting time-of-flight mass spectrometers.

BACKGROUND

Time-of-flight mass spectrometers (TOF MS) are widely used in analytical chemistry for identification and quantitative analysis of various mixtures. Sensitivity and resolution of such analysis is an important concern for practical use. To increase resolution of TOF MS, U.S. Pat. No. 4,072,862, incorporated herein by reference, discloses an ion minor for improving time-of-flight focusing in respect to ion energy. To employ TOF MS for continuous ion beams, WO9103071, incorporated herein by reference, discloses a scheme of orthogonal pulsed acceleration (OA). Since resolution of TOF MS scales with the flight path, there have been suggested multi-pass time-of-flight mass spectrometers (M-TOF MS) including multi-reflecting (MR-TOF) and multi-turn (MT-TOF) mass spectrometers. SU1725289, incorporated herein by reference, introduces a folded path MR-TOF MS using two-dimensional gridless and planar ion minors. GB2403063 and U.S. Pat. No. 5,017,780, incorporated herein by reference, disclose a set of periodic lenses for spatial confinement of ion packets within the two-dimensional MR-TOF. WO2007044696, incorporated herein by reference, suggests a scheme with double orthogonal injection for improving OA efficiency. Still, the duty cycle of OA-MR-TOF remains under 1%.

In the co-pending application, PCT Application Number PCT/IB2010/051617, incorporated herein by reference, there is disclosed a cylindrical multi-reflecting electrostatic analyzer, primarily optimized open electrostatic traps, wherein ion beam confinement in the tangential direction is not important.

Summarizing the above, the prior art multi-reflecting TOF systems enhance resolution but limit the duty cycle of pulsed converters. Therefore, there is a need for improving sensitivity and resolution of MR-TOF.

SUMMARY OF THE INVENTION

The inventor has realized that the combination of duty cycle and resolution of MR-TOF built of parallel ion minors may be substantially (about tenfold) improved by combining several improvement steps:

(i) using cylindrical topology of the analyzer, formed by wrapping a planar analyzer into a cylinder, which substantially extends the available length in a so-called drift (Z) direction, here also denoted as tangential direction;

(ii) reducing effects of the analyzer curvature by using sufficiently large ratio (at least one sixth) of the cylinder curvature radius to the distance between ion minor caps;

(iii) maintaining sufficiently small inclination angle (4 deg for resolution above 100,000) of ion mean trajectory to the X-direction (direction of reflections);

(iv) substantially reducing effects of the analyzer curvature by using at least one ring electrode for radial deflection and adjusting such deflection such that ion packets are retarded at the axis of ion minors;

(v) limiting ion packet width in the radial (Y) direction and extending ion packets in the tangential (Z) direction, in order to reduce Y-related aberrations while improving duty cycle of pulsed sources and improving space charge acceptance of the analyzer;

(vi) providing multiple measures and means for reducing ion beam divergence in the tangential (Z) direction, while maintaining 10-20 mm Z-length of ion packets;

(vii) limiting ion packet divergence in the Z-direction within the analyzer by either a set of periodic slits or, preferably, by a weak periodic lens with the focal length at least twice exceeding cap-to cap distance; Such lenses may be formed either by weak Z-modulation of the ion minors field or by a set of periodic lens within the drift space.

The inventor also realized that contrary to previous—planar MR-TOF—there appears a significant shift in which analyzer aberrations become dominant. The invention proposes multiple enhancements of ion minor properties, particularly suited for ion packets that are narrow in Y-direction.

Substantial extension of the drift length within cylindrical TOF analyzer allows the construction of a comprehensive tandem TOF spectrometer within a single analyzer, wherein two TOF spectrometers use sections of cylindrical MR-TOF. To simplify the differential pumping system, a surface induced dissociation (SID) is employed. Various embodiments of the present invention are given for illustrative purposes only will now be described, by way of example only, and with reference to the accompanying drawings in which.

Figure 5:
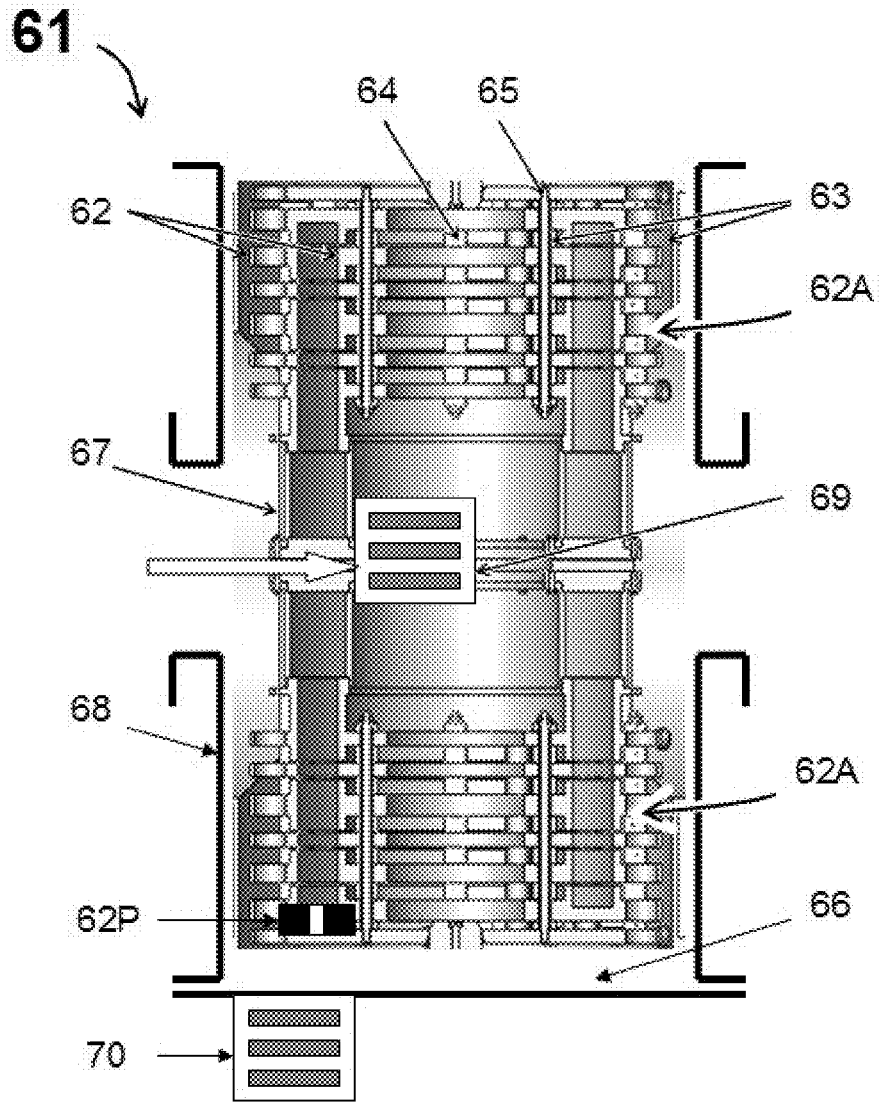
Figure 6:
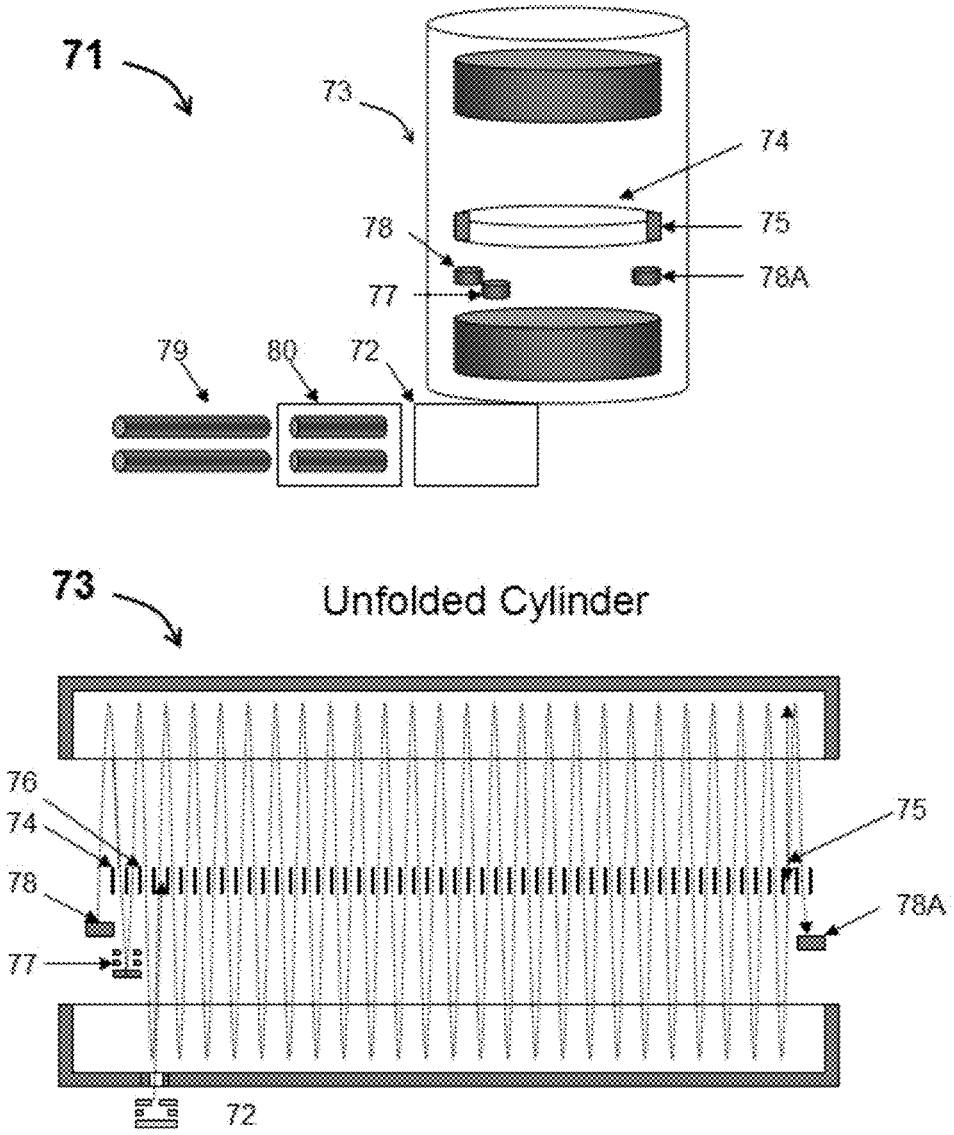

FIG. 5 presents a mechanical concept of an embodiment of the cylindrical MR-TOF;

FIG. 6 shows a diagram of embodiment of a tandem mass spectrometer based on two TOF exemplary stages within a single Cylindrical MR-TOF

DETAILED DESCRIPTION

Figure 1:
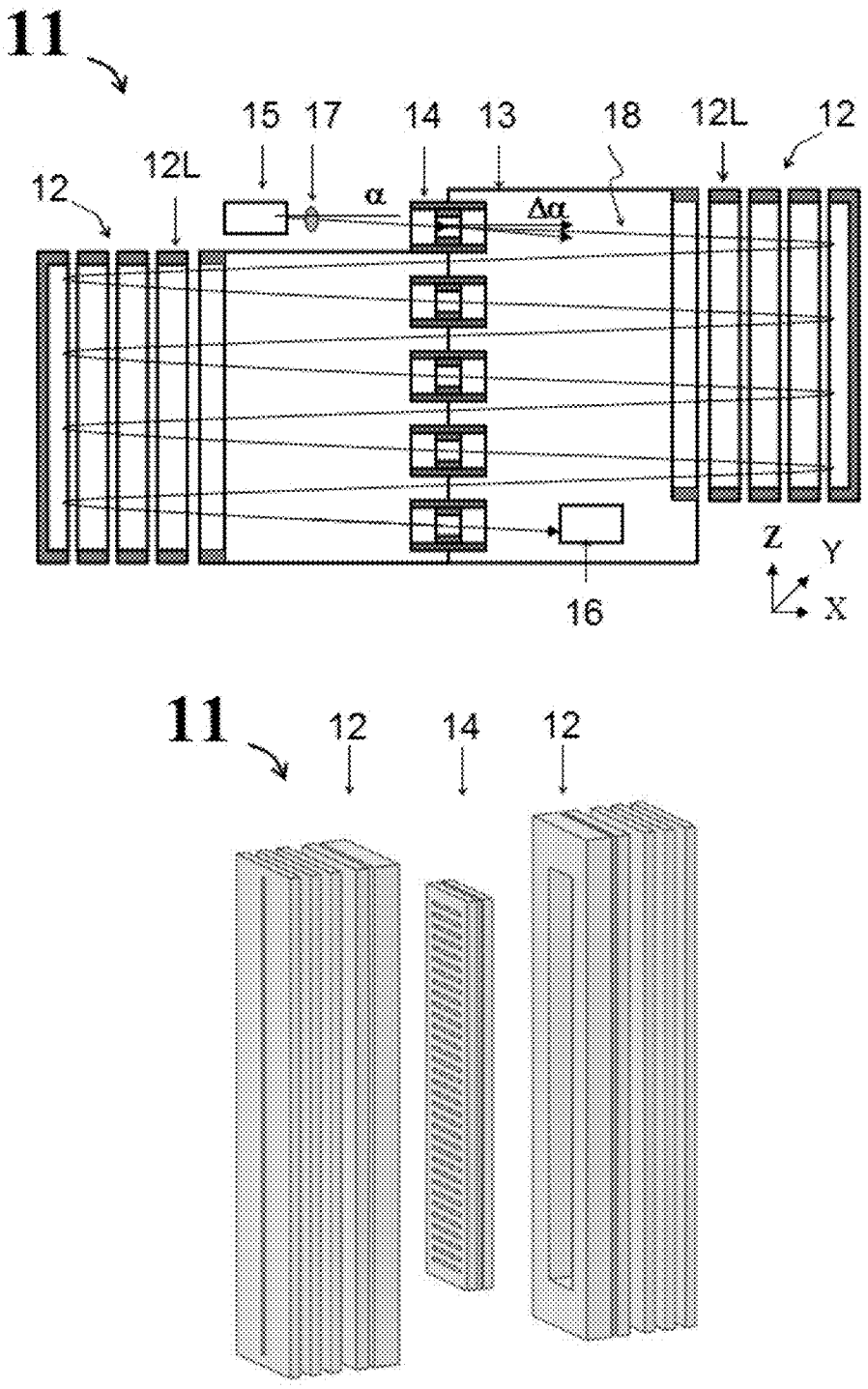
FIG. 1 depicts a planar multi-reflecting time-of-flight mass spectrometer.

Referring to FIG. 1, a planar multi-reflecting time-of-flight mass spectrometer 11 is shown comprising two parallel gridless ion minors 12 separated by a field-free space 13 and a set of periodic lenses 14 in said field free space, a pulsed ion source 15 and a detector 16. Each mirror 12 comprises at least four plate electrodes with rectangular window, one of them (called mirror lens 12L) being set at accelerating potential such that to allow a time-of-flight focusing to at least third-order relative to energy spread and to at least second-order relative to small deviations in spatial, angular, and energy spreads of ion packets, including cross terms.

In operation, the ion source 15 generates ion packets 17 and emits them at an inclination angle $\alpha$ (relative to the X-axis) having an angular ion spread $\Delta\alpha$. Ions experience multiple reflections between minors 12 while slowly drifting in the drift Z-direction, thus forming zigzag trajectories towards the detector 16. In spite of angular and energy divergence, the ion packets are confined along the mean zigzag trajectory 18 by the set of periodic lenses 14. To arrange for a small inclination angle, the ion pulsed source is tilted and then ion packets are steered past the source. To improve duty cycle of the pulsed source, the ion packets 17 are elongated in the Y-direction. If the packets were elongated in the Z-direction, this would require long drift dimension and unreasonable size of the planar analyzer to reach resolution in the order of 100,000.

In the commercial instrument Citius by LECO Corp, the planar MR-TOF has 600 mm long and 250 mm wide chamber vacuum chamber. Resolution of 50,000 is achieved at 16 m folded flight path and 6 mm Y-size of ion packets. Short ion packets and long flight path limit the duty cycle under 0.5%.

Cylindrical HRT Analyzer

In order to improve resolution and sensitivity of MR-TOF, in an embodiment, the analyzer is wrapped into a cylinder and ion packets are oriented along the drift direction. Other analyzer improvements and configurations may be provided as discussed below.

Figure 2:
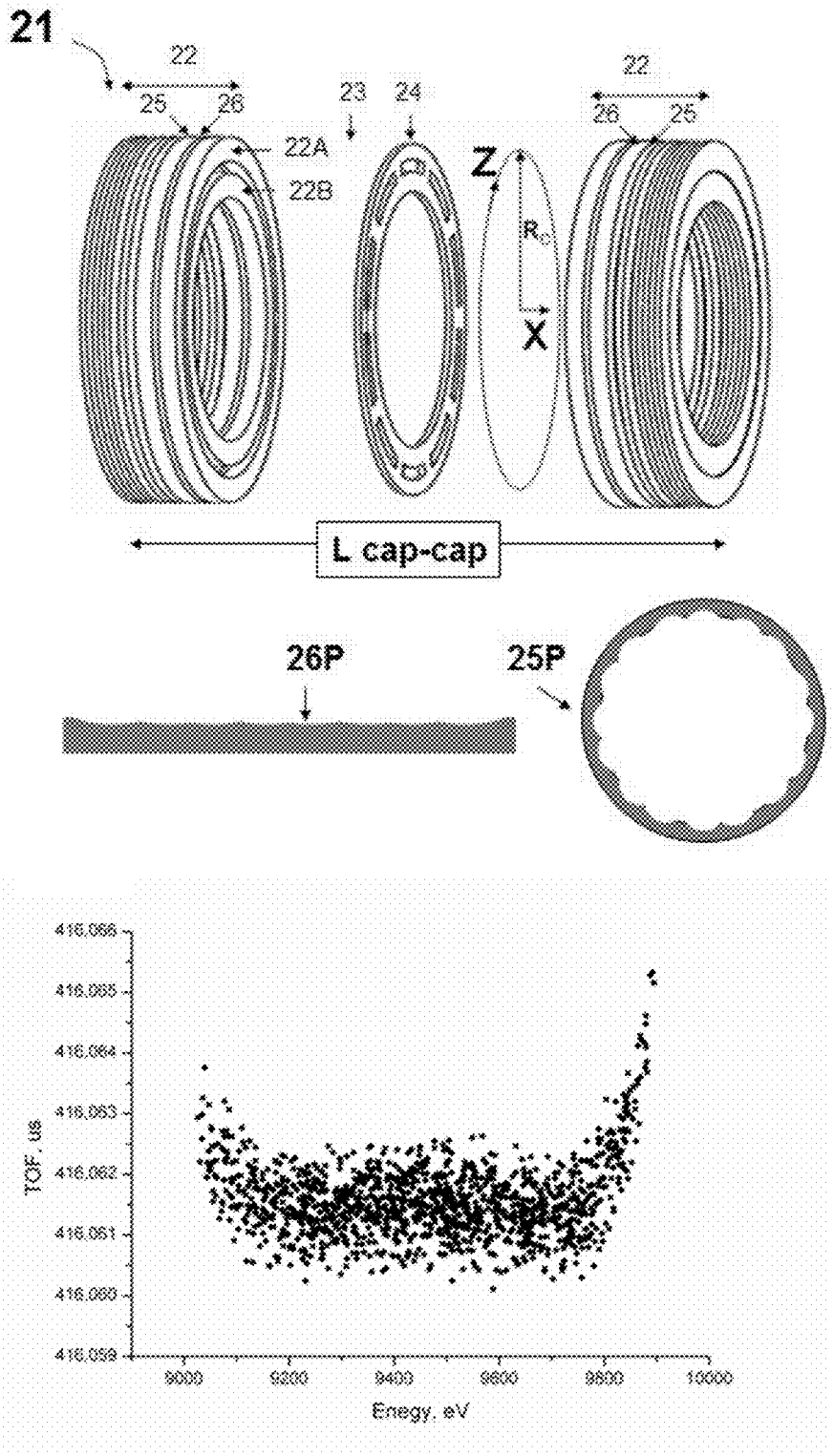
FIG. 2 shows an embodiment of a cylindrical MR-TOF.

Referring to FIG. 2, an embodiment of a cylindrical HRT 21 comprises two parallel and coaxial ion mirrors 22 separated by a field-free space 23, a set of periodic lenses or a set of periodic slits 24. As depicted, each mirror 22 may comprise two coaxial sets of electrodes 22A and 22B. In an embodiment, each electrode set 22A and 22B comprises at least three ring electrodes with distinct potentials forming an accelerating lens 22L at the mirror entrance such to allow a time-of-flight focusing to at least third-order, relative to energy spread and to at least second-order, relative to small deviations in spatial, angular, and energy spreads of ion packets, including cross terms. Further, in an embodiment, at least one of electrode sets 22A or 22B comprises an additional ring electrode 25 for radial ion deflection. In another embodiment, radial deflecting ring electrodes 26 may be placed within free space but in the close vicinity of ion mirror. In one particular embodiment, instead of using periodic lenses or slits 24, at least one ion mirror may be spatially modulated in the tangential direction, e.g. by forming a waved surface on one of mirror electrode 22P, or by introducing a periodically structured auxiliary electrode 25P.

Compared to planar analyzers 11 of prior art, the cylindrical analyzer 21 extends the circular Z-direction utilizing compact analyzer packaging. To avoid additional aberrations related to cylindrical geometry, in an arrangement, the radius $R_C$ of the cylindrical field volume should be larger than one sixth of the cap-to-cap distance L and the ion inclination angle $\alpha$ to the X-axis should be less than 3 degrees to provide aberration limit of resolution above 100,000. The relation 28 between the maximal angle and the ratio R/L is shown in the illustration. Furthermore, in order to reduce the cylindrical aberrations, the deflection angle may be adjusted to provide ion reflection precisely near the axis of ion mirrors, which is illustrated by the plot 29 showing maximal achievable resolution vs deflection angle for particular cylindrical analyzer with L=600 mm and Rc=110 mm for ion packets with initial spreads dY=mm, dZ=mm, a=mrad, da=mrad, dK=eV.

Improved Ion Mirrors for Cylindrical HRT

In order to maintain at least 100,000 aberration limit of the analyzer, the preferred geometry of ion mirrors satisfies the following conditions:

- each mirror contains at least four (4) pairs of electrodes, wherein each pair corresponds to coaxial aligned, external and internal, ring separated by the intra-electrode gap;
- at least one mirror (lens) electrode is at the attractive potential relative to field-free space, which is at least higher than the mean energy of ions per charge;
- the length of said mirror lens electrode is at least twice more compared to intra-electrode gap G;

The ratio of intra-electrode gap G to the cap-to-cap distance L is between 0.025 to 0.05). In an embodiment, the G/L ratio is 0.0382. The optimal size of electrodes and their potentials being dependent on the G/L ratio is described below.

Cylindrical minors may possess the following aberration properties:

Spatial and chromatic focusing:

$(y|\beta)=(y|\delta)=0$; $(y|\beta\beta)=(y|\beta\delta)=(y|\delta\delta)=0$;

$(\beta|y)=(\beta|\delta)=0$; $(\beta|yy)=(\beta|y\delta)=(\beta|\delta\delta)=0$;

First order time of-flight focusing $(T|y)=(T|\beta)=(T|\delta)=0$;

Second order time-of-flight focusing, including cross terms $(T\beta\beta)=(T|\beta\delta)=(T|\delta\delta)=(T|yy)=(T|y\beta)=(T|y\delta)\sim 0$;

And fifth order time per energy focusing:

$(T|\delta)=(T|\delta\delta)=(T|\delta\delta\delta)=(T|\delta\delta\delta\delta)=(T|\delta\delta\delta\delta\delta)=0$ The cylindrical minor with geometrical parameters of planar minors could be brought to the same performance by tuning potentials.

Ion Sources for Cylindrical HRT

The arrangements disclosed herein are applicable to variety of intrinsically pulsed ion sources like MALDI, DE MALDI, SIMS, LD, or EI with pulsed extraction.

Various continuous or quasi-continuous sources may be employed if using a pulsed converter like an orthogonal pulsed accelerator (OA) or a radio frequency trap with ion accumulation and pulsed ejection (trap converters). The group of orthogonal accelerators (OA) may comprise such converters as: a pair of pulsed electrodes with a grid covered window in one of them, a grid-free OA using plates with slits, a pass-through radio-frequency (RF) ion guide with pulsed orthogonal extraction, and an electrostatic ion guide with pulsed orthogonal extraction. The group of trap converters comprises: an RF ion guide with an axial potential well and with pulsed voltage extraction; and a linear ion trap with radial pulse ejection. In an embodiment, any pulsed converter further comprises an upstream gaseous RF ion guide (RFG) such as an RF ion funnel, an RF ion multipole, preferably with axial field gradient, an RF ion channel; and an RF array of ion multipoles or ion channels. Preferably, said gaseous RF ion guide comprises means for ion accumulation and pulsed extraction of an ion bunch, and wherein said extraction is synchronized to OA pulses. Variation of the ion accumulation time allows adjustment of signal intensity, thus improving dynamic range of MR-TOF.

Accounting for a small (1-3 degrees) inclination angle $\alpha$ of ion trajectory in the MR-TOF analyzer, special measures should be taken (a) to arrange the inclination angle without tilting of ion packets' time front; and (b) to avoid spatial interference of ion source or converter with ion packets after first reflection by ion mirror. In one method, said ion source or converter are displaced from the X-Z symmetry axis of the analyzer, and the ion packets are returned onto said X-Z symmetry axis by at least one pulsed deflector. In another method, the parallel emitting source (like MALDI, SIMS, ion trap with radial ejection) is tilted at the angle $\alpha/2$ and then ion packets are steered forward at the angle $\alpha/2$ to arrange ion inclination angle $\alpha$ to the axis X. Yet another method comprises ion injection via a pulsed segment in one of ion minors. The method allows ion packet initial inclination equal to the inclination angle of ion trajectory within the analyzer.

Figure 3:
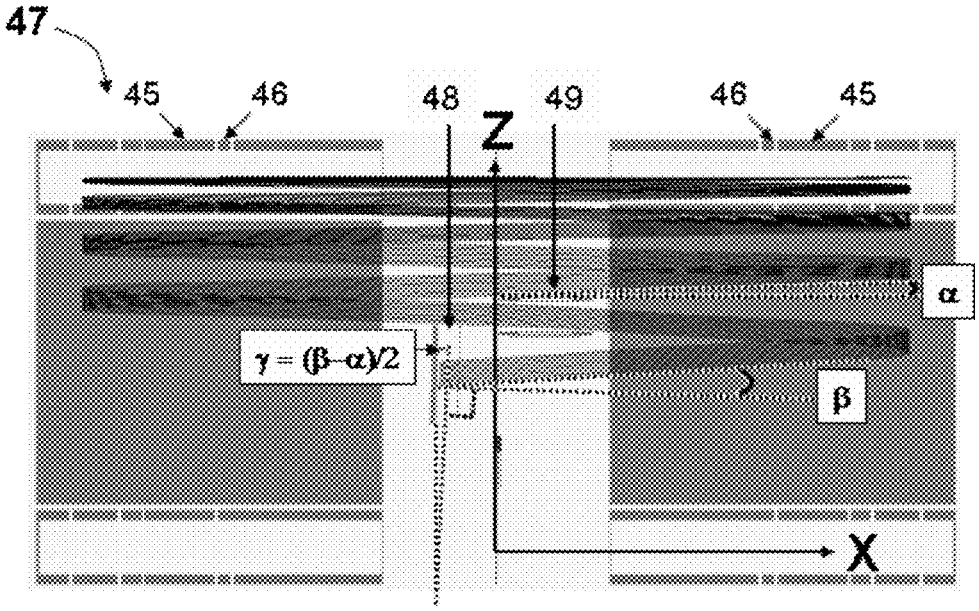
FIG. 3 shows an embodiment with a tilted orthogonal accelerator followed by ion packet steering, in the depicted embodiment the accelerator is aligned tangentially.

Referring to FIG. 3, one particular method is suited for OA pulsed converters 48 which emit ions at the inclination angle 90-β relative to the incoming continuous ion beam. The angle β is defined by acceleration voltages in a continuous ion beam $U_z$ and at pulsed acceleration $U_x$: $\beta=(U_z/U_x)^{1/2}$. In this method, the OA 48 is reverse tilted at the angle γ (relative to Z axis) and then after at least one ion reflection within the analyzer the ion packets are reverse steered at the angle γ, wherein the angle $\gamma=(\beta-\alpha)/2$. The tilt and steering mutually compensate rotation of the time front. A larger ion displacement of the OA provides more room for OA.

Divergence of Ion Packets

In an embodiment, ion packets could be confined along the main trajectory by either a set of periodic slits or by spatially modulated (but static in time) electric fields of ion minors. Still, to obtain resolution at the level above 100,000 it is preferable keeping those spatially focusing means just for compensation of mechanical imperfections and of stray electric and magnetic fields and not for strong focusing of ion packets. Simulations suggest that both spatially modulated fields or the periodic lenses should have focal length at least twice longer than the cap-to-cap distance of HRT. On the other hand, analysis of multiple practical pulsed sources and converters indicates that the ion packets could be formed with low angular divergence under 1 mrad which allows using MR-TOF analyzers with weak spatial focusing in the tangential Z-direction. For multiple ion sources the estimated emittance in two transverse directions is θ1 $mm^2$*eV:

For DE MALDI source θ<1 $mm^2$*eV for M/z<100 kDa at <200 m/s radial velocity;

For OA converter past RF guide: θ<0.1 $mm^2$ eV at thermal ion energy in RFQ;

For pulsed RF trap: θ<0.01 $mm^2$*eV for M/z<2 kDa at thermal ion energy;

The surprisingly small emittance appears due to a small transverse size of initially formed ion packets under 0.1 mm In the case of radial symmetric ion sources, the maximal emittance of 1 $mm^2$*eV can be converted into an angular-spatial divergence smaller than D<20 mm*mrad by accelerating ion packets to 10 keV energy. Such divergence can be properly reformed by a lens system to less than 2 mm*10 mrad divergence in the ZY-plane tolerated by ion minors and to less than 20 mm*1 mrad in the XZ-plane which could be transferred through the MR-TOF electrostatic analyzer without ion losses and without additional strong refocusing in the Z-direction.

Particular Example of Cyl-HRT Mass Spectrometer

Figure 4:
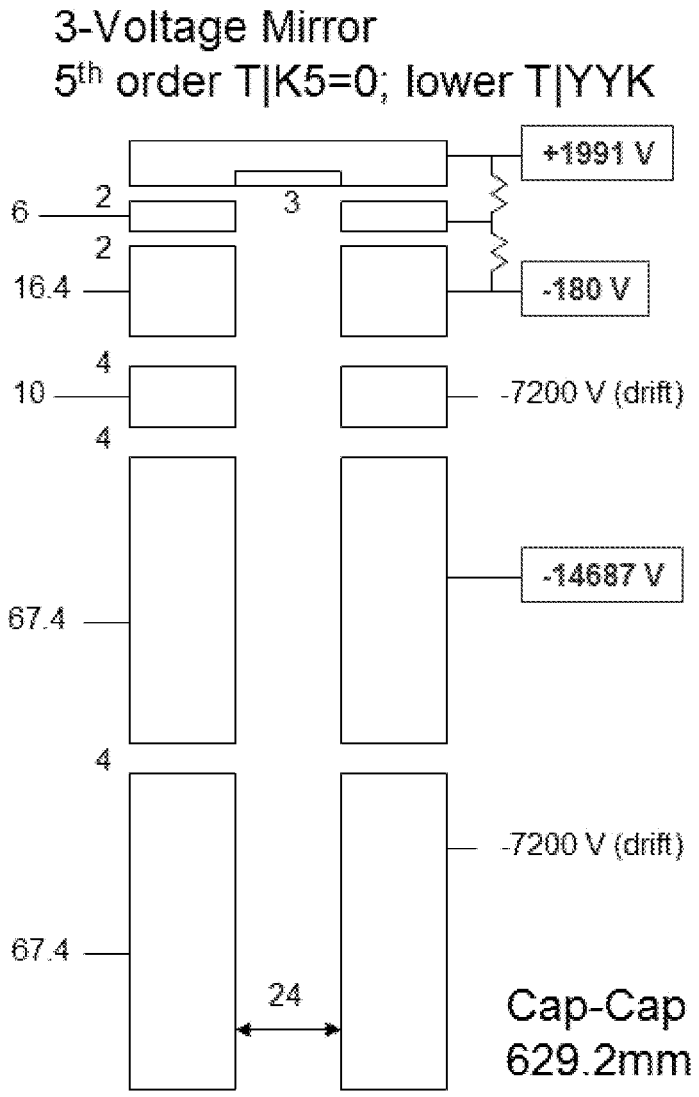
FIG. 4 shows an embodiment of an ion minor for high order energy focusing.

Referring to FIG. 4, there is provided a particular example of a cylindrical HRT with sizes and voltages denoted on the analyzer schematic 51. As depicted, the analyzer is coupled with a tilted orthogonal accelerator Referring to FIG. 5, one embodiment of a cylindrical HRT analyzer 61 is depicted using lathe plate electrodes 62, precise ceramic spacer 63, ground rods 64 for axial electrode alignment, clamping rods 65, base flange 66, standoffs or flight tubes 67 with low thermal expansion coefficient, and cylindrical stainless vacuum chamber 68. The stack of ion mirror electrodes is precisely spaced by spacers 62, axially aligned by ground rods 63 (for example made of Vespel for vacuum compatibility) and clamped by rods 65 to form minor assembly 62A. Minor assemblies 62A are placed onto the base flange 66 via precision-length thermally stable standoffs 67 thus forming an analyzer assembly 61A. The vacuum chamber 68 is mounted on top of the analyzer assembly. In one particular embodiment, an orthogonal accelerator 69 is mounted on the analyzer assembly (for exact relative positioning), while the upstream ion optics (IOS) has means for ion beam steering to ensure an aligned introduction of continuous ion beam into the OA 69 while compensating possible mechanical misalignments between the IOS and OA. In another particular embodiment, an ion trap pulsed converter 70 is placed outside of the vacuum chamber 68, and ion packets are introduced via a pulsed section of the ion minor 62P.

Tandems

The cylindrical HRT (CHRT) in many ways improves tandem mass spectrometry in such combinations as tandem with various types of MS1 and CHRT as MS2 (MS-CMRT), Ion mobility Spectrometer with CHRT (IMS-CMRT), comprehensive TOF-TOF for parallel MS-MS analysis (CTT), MS-CTT and IMS CTT. Most of tandem mass spectrometers presume ion fragmentation between two MS stages. The fragmentation may employ prior art fragmentation methods like collision induced dissociation (CID), surface induced dissociation (SID), photo induced dissociation (PID), electron transfer dissociation (ETD), electron capture dissociation (ECD), and fragmentation by excited Rydberg atoms or ozone. Those tandems are expected to be compatible with an upfront sample separations like liquid chromatography (LC), gas chromatography (GC), electrophoresis (CE), so as with tandem chromatographic separations like LC–CE and GC×GC.

As described in the co-pending application, PCT Application Number PCT/IB2011/055395, incorporated herein by reference, one aspect of tandems' operation is the ability of applying fast (100-200 kHz) pulse coding at the pulsed converter. The method of fast coded pulses implies generation of repeatable interval string with unique time intervals between each pulse. Thus obtained interleaved (from variety of starts) spectra are then decoded based on the knowledge of the intervals. The method is particularly suited for tandems wherein regular (single start) spectra are much sparser (less populated by peaks). Then the decoding is capable of recovering weak series at very small intensity corresponding to approximately 5-8 ions. The cylindrical analyzer improves the decoding efficiency, since the number of pulses per flight time in the analyzer drops proportional to the duty cycle gain, approximately 10-fold compared to planar MR-TOF. This, however, does not slow down frequency of start pulses, since the duty cycle gain is primarily obtained due to faster flight time, which becomes possible due to lower analyzer aberrations.

Cylindrical HRT opens the way for a novel apparatus—comprehensive TOF-TOF (CTT) mass spectrometer built within a single analyzer. Referring to FIG. 6, one embodiment of CTT 71 comprises an ion trap 72, a cylindrical multi-reflecting analyzer 73 with a set of periodic lenses 74, a reflecting end-lens 75, a timed ion selection gate (TSG) 76, a surface induced dissociation (SID) cell 77, placed in within the analyzer 73 and an ion detector 78. Optionally, the CTT spectrometer further comprises an up-front mass separator 79 (like analytical quadrupole), a second fragmentation cell 80 between the mass separator 79 and the trap 72, and an auxiliary detector 78A.

In operation, the ion trap 72 receives a continuous flow of ions, traps them and pulse ejects them into the cylindrical analyzer at the expected period of 1-2 ms sufficient for ion dampening in the trap. The trap may be an axially or radial ejecting ion trap. In an embodiment, ions are injected via a pulsed section in one ion minor. Once ions bounce back from the opposite minor, the voltage of the pulsed section is restored to normal TOF regime. Ions are injected at small inclination angle (say 1 deg), which matches dense pitch (10 mm) of the periodic lens 74. At 220 mm central diameter, the perimeter of the periodic lens is 690 mm. After approximately 50 reflections from the ion entry there is placed an end lens 75 which constantly reverses the ion motion by steering ion packets for 1 degree. Ion packets pass again the same 50 lenses through the analyzer and get to a timed gate 76, followed by surface induced dissociation (SID) cell 77. The timed gate 76 and the cell 77 may be separated by one pitch space to allow another ion reflection between the devices. With below described provisions on periodic interleaved timed ion selection, a packet of parent ions hit the detector at moderate ion energy between 10 to 100 eV this way generating fragment ions out of impinging parent ions. After a delay, a pulsed voltage signal is applied to the cell to extract a short ion packet of secondary ions. Either SID cell is tilted at said 1 degree, or an additional steering pulse is applied past the cell in order to direct secondary ions through the same multi-reflecting analyzer and towards the detector 78. The secondary ions become time-separated within the same CHRT analyzer while flying between the SID cell 77 and the detector 78. The number of reflections could be chosen depending on the desired resolution in the second MS stage.

For clarity, let us choose a case of single mirror reflection within the MS2 stage, which is expected to provide resolution between 1,000 and 3,000. In this arrangement, the flight path within the second stage is 100 times smaller than in the first stage of parent separation. Thus, non-overlapped fragment spectra could be obtained for every parent ions at every single pulse of the converter ion trap 72. The method eliminates ion losses of parent ion selection which are present in conventional MS-MS techniques, though, at low time resolution (R=100) of parent ion selection.

In the most general method of operation, the resolution of parent selection is improved by periodically applied pulses on the TSG 75, and wherein the grid of TSG pulses is moved by a fraction of TSG period between acquisitions of spectra. Such interleaving of TSG pulses improves resolution of parent ion selection for the cost of proportional loss in the sensitivity. Still, compared to sequential parent selection methods, the described method of parallel analysis improves sensitivity by factor of 100—called sensitivity gain of parallel analysis. Compared to prior art CTT methods within planar MR-TOF, the cylindrical MR-TOF improves sensitivity gain proportional to ion path in the first TOF, i.e. approximately by factor of 3 to 5 at the same analyzer size. The proposed here method of combining two MS stages within one analyzer notably reduces cost of the CTT.

Again referring to FIG. 6, the same apparatus 71 may be employed in another mode of MS-MS-MS without reconfiguring hardware. In this mode, parent ions are sequentially selected in the first MS 79, preferably analytical quadrupole, and then are subjected to fragmentation in the fragmentation cell 80, preferably either CID or ETD cell. Fragment ions of the first generation (daughter ions) are then converted into pulsed ion packets by the trap 72. The daughter ions are then subjected to the above described analysis in parallel MS-MS mode to generate spectra of grand-daughter ions in the parallel fashion. Because of high selectivity of triple MS-MS analysis, it is expected that the first MS may be operated with a wide transmission window of 10-20 amu, which minimizes ion losses at parent ion selection, while the CTT could operate either without TSG 75 or at low TSG interleaving factor. In addition to high selectivity and confidence of MS3 analysis, the method may provide additional information on analyte molecules composition.

Again referring to FIG. 6, the same apparatus 71 may be employed yet in another mode of sequential MS-MS tandem without reconfiguring hardware. In this mode, parent ions are selected in the first quadrupole MS 79, fragmented in the cell 80 and are then analyzed within C-HRT analyzer. The back-end lens 77 is switched off and ions get onto the auxiliary detector 78A after single pass through the analyzer. The method allows obtaining high resolution of fragment analysis in the range of 100,000, though at a cost of ion losses at parent ion separation.

Again referring to FIG. 6, the same apparatus 71 may be employed in a fourth mode of sequential MS-MS analysis with high resolution in both MS stages. In such mode, parent ions are separated in the CHRT, selected by TSG 75, hit SID cell 77 and are then steered towards the auxiliary detector 78A to allow long ion passage for secondary ions through the entire CHRT analyzer for higher resolution. The mode can be complemented by one more MS stage in the up-front quadrupole.

The invention claims the new apparatus for multi-mode MS-MS analysis.

Although the present invention has been describing with reference to preferred embodiments, it will be apparent to those skilled in the art that various modifications in form and detail may be made without departing from the scope of the present invention as set forth in the accompanying claims.

What I claim is:

1. A multi-reflecting time-of-flight mass spectrometer comprising:

one of a pulsed ion source or a pulsed converter;

at least two parallel electrostatic ion mirrors having a field-free region spaced there between, wherein each of said ion mirrors has at least one electrode with attracting potential, and wherein each of the ion mirrors includes a mirror cap, an inner ring electrode set, and an outer ring electrode set to form a cylindrical volume between the outer ring electrode set and inner ring electrode set, and further wherein a mean radius of the cylindrical volume is larger than one sixth of a distance between minor caps, and even further wherein one of said ion mirrors or said field free space comprises at least one ring electrode for radial ion deflection;

wherein at least one of the ion minors includes a spatially modulated surface defining a plurality of arcuate segments extending in a tangential direction for limiting ion divergence in the tangential direction, the plurality of arcuate segments including a first concave segment concave in the tangential direction, a second concave segment concave in the tangential direction, and a convex segment convex in the tangential direction and extending in the tangential direction from the first concave segment to the second concave segment; and wherein the one of a pulsed ion source or a pulsed converter generates ion packets with a phase space in the tangential direction of less than 1 mm*deg.

2. An apparatus as set forth in claim 1, further comprising at least one of:

(i) a set of periodic lenses wrapped along a curved axis; or (ii) a set of periodic slits wrapped along the curved axis.

3. An apparatus as set forth in claim 1, wherein the height of the mirror electrodes with attracting potential is at least twice larger than a gap between outer and inner mirror electrodes.

4. An apparatus as in claim 1, wherein the pulsed source comprises one orthogonal pulsed converter selected from the group consisting of: (i) an orthogonal pulsed accelerator; (i) a grid-free orthogonal pulsed accelerator; (iii) a radiofrequency ion guide with pulsed orthogonal extraction; (iv) an electrostatic ion guide with pulsed orthogonal extraction; and (v) any of the above accelerators preceded by an upstream accumulating radio-frequency ion guide.

5. An apparatus as in claim 1, wherein the pulsed source or pulsed converter is tilted relative to Z axis and an additional deflector steers ion packets at the same angle after at least one ion reflection within said ion mirror.

6. An apparatus as in claim 1, further comprising means for ion packet refocusing past the ion source in order to reduce angular divergence of ion packets past the ion source under 3 mrad.

7. An apparatus as in claim 1, for the purpose of obtaining tandem mass spectra, further comprising at least one of the group: (i) an SID cell; (ii) a timed ion selector gate; (iii) a back-end steering lens; (iv) an auxiliary detector.

8. An apparatus as in claim 7, further comprising an upstream first mass or ion mobility separator and a fragmentation cell.

9. A method of mass spectral analysis comprising:

arranging multiple reflections of ion packets between electrostatic fields of two parallel electrostatic ion mirrors spaced apart by a field-free region;

arranging the electrostatic fields of the ion minors by providing a field segment with an attracting potential;

arranging the reflecting fields within cylindrical intra-electrode cavities, wherein the reflecting fields include a two-dimensional structure of cylindrical symmetry, and wherein a mean radius of a cylindrical volume of the reflecting fields is larger than one quarter of distance between outer boundaries of said reflecting fields;

arranging radial ion deflection;

limiting ion divergence in the tangential direction by modulating a surface of at least one of the ion mirrors to define a plurality of arcuate segments extending in the tangential direction, the plurality of arcuate segments including a first concave segment concave in the tangential direction, a second concave segment concave in the tangential direction, and a convex segment convex in the tangential direction and extending in the tangential direction from the first concave segment to the second concave segment; and generating ion packets with a phase space in the tangential direction of less than 1 mm*deg.

10. A method as set forth in claim 9, wherein the step of limiting ion divergence in the tangential direction comprises one of the steps of: (i) forming a static and periodically spatially modulated electrostatic field within an ion mirror or within a set of periodic lens wrapped along the curved axis; and (ii) limiting divergence by a set of periodic slits.

11. A method as set forth in claim 9, further comprising:

reducing the largest attracting potential in the ion mirror; and reducing time-of-flight aberrations, wherein the length of attracting potential region is at least twice larger than a radial width extending from an inner ring of one of a plurality of inner ring electrode sets to an outer ring of one of the outer ring electrode sets.

12. A method as in claim 9, further comprising:

providing fifth order energy focusing at an aberration limit of resolution above 100,000.

13. A method as in claim 9, further comprising:

accelerating the ion packets across a potential above 10 kV; and refocusing the ion packets past an ion source in order to reduce angular divergence of ion packets past said ion source under 3 mrad.

14. A method as in claim 9, further comprising:

obtaining tandem mass spectra in parallel by selecting one of the following substeps:

(i) impinging ions onto a surface at an energy range from 10 to 100 eV to form fragment ions and pulsed extracting the fragment ions into the same electrostatic field of cylindrical ion mirrors for time-of-flight analysis;

(ii) time selection of parent ions by interleaved sequences periodic pulses with acquisition of separate fragment spectra per single time shift of periodic selection pulses; and (iii) steering ion packets to reverse a drift direction.

15. A method as in claim 9, further comprising:

a step of an upstream mass or ion mobility separation followed by an ion fragmentation step.

16. A method as in claim 14, wherein said steps are combined to implement at least the following types of tandem mass spectrometric analysis: (i) sequential MS-MS analysis with upstream mass separation and high resolution fragment analysis in the cylindrical fields; (ii) MS to the $3^{rd}$ analysis with sequential up-stream parent separation and subsequent parallel MS-MS analysis in cylindrical fields; and (iii) sequential high resolution MS-MS analysis—both provided within cylindrical fields and with ion passage through the majority of cylindrical field perimeter.

17. The apparatus as in claim 1, wherein the first concave segment, the second concave segment, and the convex segment define a waved surface.

18. The method as in claim 9, further comprising forming a waved surface on at least one of the ion mirrors in the tangential direction for limiting ion divergence in the tangential direction.

19. The apparatus as in claim 1, wherein the at least two ion mirrors are spaced by spacers and axially aligned by ground rods, and clamped by rods to form an assembly, and wherein the assembly is disposed on a base flange.

20. The method as in claim 9, further comprising:

providing a spacer between the ion mirrors;

axially aligning the ion mirrors with a ground rod;

clamping the ion mirrors to form an assembly; and placing the assembly on a base flange.

* * * * *